US006234652B1

(12) United States Patent
Tang

(10) Patent No.: US 6,234,652 B1
(45) Date of Patent: May 22, 2001

(54) CANDLE LAMP DECORATION

(76) Inventor: Chi-Li Tang, 1008 W. Ave J-2, Lancaster, CA (US) 93534-9998

( * ) Notice: Subject to any disclaimer, the term of this patent is extended or adjusted under 35 U.S.C. 154(b) by 0 days.

(21) Appl. No.: 09/201,216

(22) Filed: Nov. 30, 1998

(51) Int. Cl.[7] ..... F21V 21/00
(52) U.S. Cl. ..... 362/392; 362/252; 362/810
(58) Field of Search ..... 362/252, 810, 362/392, 234

(56) References Cited

U.S. PATENT DOCUMENTS 1,736,820 * 11/1929 Black ..... 362/392 X
3,749,904 * 7/1973 Graff ..... 362/265

* cited by examiner

*Primary Examiner*—Stephen Husar

(57) ABSTRACT

One kind of candle structure using wire to replace the cotton thread candlewick inside of a typical candle, and using light bulb to replace candlelight, with the light bulb optical ring in a flower wreath mode beneath it to surround the external of the candle bottom. After power is connected, turn on the switch on power cable, make the light bulb of candle top and light bulb optical ring outside the candle bottom to be lighted at the same time, attaining the effect of decorating the whole candle. It also provides the application of illumination, and further can become a decorative item in considerable beauty.

1 Claim, 1 Drawing Sheet

CANDLE LAMP DECORATION

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Since the typical candle production process is to use the mold of candle shape, to pierce from the candlewick from beneath upward through the reserved hole of the mold, then pour in wax liquid, till the wax liquid cools down, the candlewick would condensation with wax oil to one entity, forming a candle structure with candlewick.

But the central candlewick of a typical candle is composed of a tender cotton thread which is not rigid, often, during the process of pouring wax liquid, the flowing wax liquid causes the candlewick to deviate from its correct central position. One candle with deviated axial core, during the burning process, besides being unable to evenly and correctly burn a candle from top to bottom and easy to cause drain of wax liquid, it also, due to eccentric burning, incurs a situation of deviated swing and fall, so as to cause a fire.

Next, after a candle is lighted, the melting wax liquid normally drips along the candle body down, to damage the outlook shape of a candle, causing the candle to be ugly in outlook. In particular, some unique candles in bright color and new model, through combustion, gradually turn to be scattered. It is unable to retain their beautiful outlook and is really a pity.

What is more, during these years, the environmental protection cognition has been reinforced. The smoke produced by candle combustion is not only a potential public hazard, but also harmful to human health.

BRIEF SUMMARY OF THE INVENTION

In order to solve the defect of a typical candle, not to make a candle cause drain of wax liquid due to deviation from the axial center, and to further prevent a fire accident; not to make a candle damage the candle itself due to combustion, it can further maintain the candle outlook and prevent the smoke incurred from candle burning from causing public hazard and danger to human health.

Therefore, this invention is designed with focus on a slightly wider bottom area, without relying on any aid from a candlestand, to allow a candle to stand by itself; or a new model candle in bright color and unique shape which can stand by itself as its bottom area is wider. It does not only maintain the illumination use, but can also become a rather beautiful decorative item.

DETAILED DESCRIPTION OF THE INVENTION

Figure 1:
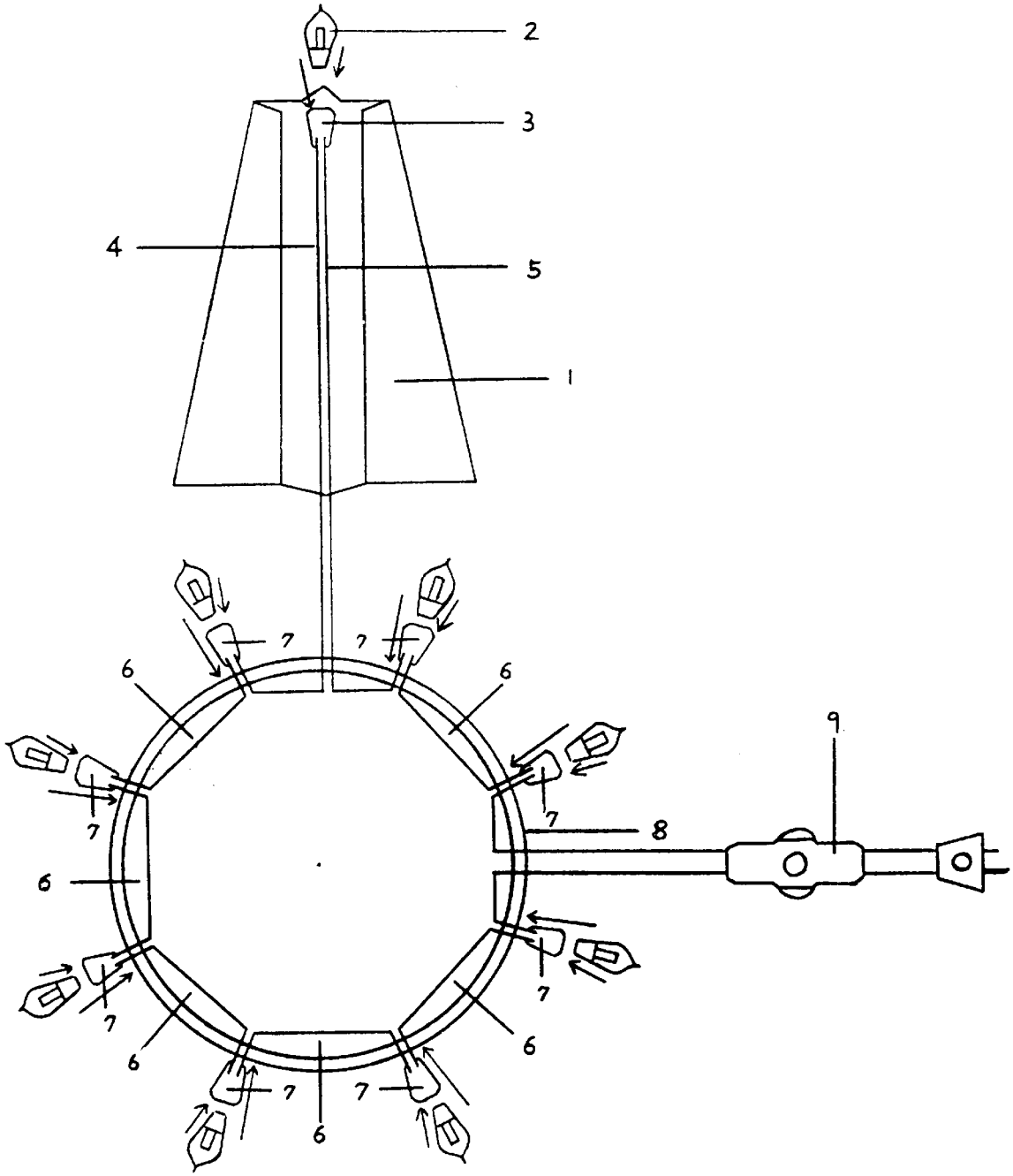
FIG. 1 is the basic structure drawing of the implementation example of this invention.

Please refer to FIG. 1, this creation is a kind of candle structure using wire to replace the cotton thread candlewick inside of a typical candle, and using light bulb to replace candlelight. Its structure shall include the candle itself (1), one soft end seat located in the top part of a candle to allow insertion of a bulb (3), while the light bulb (2) is inserted from this opening soft end and fixed, then extrudes through the candle top.

Beneath the soft end seat (3), 2 wires (4, 5) are connected, (4,5) in top down direction, passing through the central part of candle itself and out of the candle bottom; the extended wires (4) and (5) through the candle bottom are connected with one cable (6), while this cable (6) is connected to several light bulb soft end seats (7) already with inserted bulbs according to several evenly divided sections; and this cable is stabilized to a fixed circle (8).

Then, use 2 soft end seats of light bulb among them on cable (6), to connect to one power cable (9) devised with switch and plug.

It is to use the principle of mutual power serial connection between wires, to fulfill the whole invention.

I claim:

1. A decorative electric candle assembly comprising a central main wax candle supporting an electric lamp socket at the top of said central main wax candle and having electrical wires passing down inside through the center of said central main wax candle, a solid ring base located at the bottom of said central main wax candle for supporting and stabilizing said central main wax candle, said solid zing base further supporting a plurality of electrical lamp sockets and lamps which are electrically connected to said electrical wires passing down through the center of said central main wax candle at one end and at the other end are connected to an electric power switch and power plug.

* * * * *